US006144351A

United States Patent [19]

Zimlich

[11] Patent Number: 6,144,351

[45] Date of Patent: Nov. 7, 2000

[54] FIELD EMITTER DISPLAY BASEPLATE AND METHOD OF FABRICATING SAME

[75] Inventor: David A. Zimlich, Boise, Id.

[73] Assignee: Micron Technology, Inc., Boise, Id.

[21] Appl. No.: 08/802,662

[22] Filed: Feb. 19, 1997

[51] Int. Cl.[7] ..... G09G 3/22; H01J 1/02; H01J 1/16

[52] U.S. Cl. ..... 345/74; 345/75; 313/309; 313/336; 313/351

[58] Field of Search ..... 345/74–75; 313/495–497, 313/309, 336, 351

[56] References Cited

U.S. PATENT DOCUMENTS 5,578,902 11/1996 Vickers ..... 313/496
5,598,057 1/1997 Vickers ..... 313/495
5,668,437 9/1997 Jones et al. ..... 313/336
5,712,534 1/1998 Lee et al. ..... 315/169.3
5,808,400 9/1998 Liu ..... 313/306
5,847,504 12/1998 Baldi ..... 313/336

*Primary Examiner*—Mark R. Powell
*Assistant Examiner*—Anthony J. Blackman
*Attorney, Agent, or Firm*—Dorsey & Whitney LLP

[57] ABSTRACT

A field emission display and method of fabricating same in which the emitters are fabricated on a polysilicon layer that is deposited on top of a relatively thick oxide insulating layer. The polysilicon layer extends into gaps formed in the insulating layer to make contact with a conductive layer deposited on a nonconductive substrate. Because of the spacing between the substrate and the polysilicon layer provided by the insulating layer, the conductive layer can extend beneath the emitters to periodically make contact with the polysilicon layer through spaced-apart gaps in the insulating layer. A thin oxide insulating layer is formed over the polysilicon layer, and a second polysilicon layer is then deposited over the thin oxide layer to form an extraction grid.

101 Claims, 5 Drawing Sheets

FIELD EMITTER DISPLAY BASEPLATE AND METHOD OF FABRICATING SAME

This invention was made with government support under Contract No. DABT-63-93-C-0025 by Advanced Research Projects Agency (ARPA). The government has certain rights to this invention.

TECHNICAL FIELD

This invention relates to field emission displays, and more particularly to a baseplate structure for a field emission display.

BACKGROUND OF THE INVENTION

Field emission displays are well known and have been proposed as alternatives for conventional cathode-ray tube displays. A conventional field emission display 10 is illustrated in FIG. 1. The conventional field emission display 10 includes a rectangular, generally planar baseplate 12 and a similarly sized, generally planar viewing screen 14 positioned in parallel with the baseplate 12 and spaced a small distance therefrom by a support structure, such as spacers 16. It will be understood by one skilled in the art that the display 10 shown in FIG. 1 is for illustrative purposes only, and is not drawn to scale.

The baseplate 12 includes a substrate 20 of a nonconductive material such as glass, although substrates have also been formed from silicon of one variety or another. In the case of a glass substrate 20, the surface of the substrate 20 facing the display screen 14 is coated with a metal layer 22 such as chromium. As shown in FIG. 1, the metal layer 22 extends only part of the way across the surface of the substrate 20. A layer polysilicon 26 is then deposited on the substrate 20 and at least a portion of the metal layer 22. The polysilicon layer 26 is appropriated doped to be as conductive as reasonably possible. However, as explained below, the resistance of the polysilicon layer 26 is nevertheless higher than desirable.

With further reference to FIG. 1, a large number of conical emitters are formed in the polysilicon layer 26, although only nine emitters 30 are illustrated in FIG. 1. The emitters 30 are generally arranged on the substrate 20 in rows and columns, with the emitters 30 in each column being connected to each other as explained further below. Often, the emitters 30 are arranged in sets, each of which consist of several emitters 30 interconnected to each other. As used herein and in the detailed description of the preferred embodiment and the claims, the term "emitters" encompasses emitter sets.

After the emitters 30 have been formed, a layer of a silicon oxide, such as silicon dioxide 34, is deposited on the polysilicon layer 26. Next, a second layer of polysilicon material 38 is conformably deposited over the oxide layer 34. Finally, a second layer of a metal 42 is deposited over the polysilicon layer 38 to make contact with the polysilicon layer 38. In some circumstances, the metal layer 42 may be deposited on the oxide layer 34 with the polysilicon layer 38 deposited over the metal layer 42. However, in either case, the purpose of the metal layer 42 is to make contact with the polysilicon layer 38. In some cases, the extraction grid may be formed by depositing a layer of metal on the oxide layer 34 in place of the polysilicon layer 38. In such a case, it is unnecessary to use a second metal layer 42 since the metal layer forming the extracting grid serves as the conductor for the extraction grids.

An emitter 30 and its surrounding structure are shown in greater detail in FIG. 2. Openings 50, 52 are formed in the polysilicon layer 38 and the oxide layer 34, respectively, around each emitter 30. The polysilicon layer 38 serves as an extraction grid. When the extraction grid is biased to a positive voltage, for example, 40 volts, and the emitter 30 is at ground, the emitter 30 emits electrons which, as explained below, are attracted to the viewing screen 14 (FIG. 1).

The extraction grids, like the emitters, are generally arranged in rows and columns. However, in the case of the extraction grids, the extraction grids in each row are typically connected to each other and isolated from the extraction grids in the other rows. (It will be understood that the terms "rows" and "columns" are interchangeable in that a row becomes a column by simply rotating the display 90 degrees. Thus, the emitters in each row may be interconnected and the extraction grids in each column may be interconnected.) The emitters 30 in each column are generally connected to each other and isolated from the emitters 30 in the other columns by forming the polysilicon layer 26 and the metal layer 22 in columns that are separated from each other. The metal layer 22 thus makes contact with the polysilicon layer 26 at only the top or bottom of the display. Similarly, the extraction grids in each row are generally connected to each other and isolated from the extraction grids of the other rows by forming the polysilicon layer 38 in rows that are separated apart from each other in the same manner that the polysilicon layer 26 and metal layer 22 are generally formed in columns that are separated from each other. In such cases, the metal layer 42 makes contact with the polysilicon layer 38 only at either the left or right side of the display 10.

With further reference to FIG. 1, the viewing screen 14 includes a transparent panel 60 made from a material such as glass or quartz. The inner surface (i.e., the surface facing the baseplate 12) is coated with a transparent conductive material 62, such as iridium. Finally, the surface of the conductive material 62 is coated with a layer of cathodoluminescent material 64.

In operation, the anode formed by the conductive material 62 is biased to a relatively high voltage, such as 1,000 volts. A column of emitters 30 is biased to a negative voltage or ground potential, and an extraction grid row formed by the polysilicon layer 38 is biased to a positive voltage, such as about 40 volts. The voltage differential between the emitter 30 and an extraction grid at the intersection of the biased column of emitters and row of extraction grids causes the emitter 30 to emit electrons. These electrons are attracted by the positive potential of the anode 62, thereby causing the electrons to strike the cathodoluminescent material 64 and emit light. The light is then viewed through the transparent panel 60.

Although the conventional field emission display shown in FIGS. 1 and 2 is satisfactory in theory, in practice it exhibits a number of serious limitations. First, the resistance of the polysilicon layer 26 is sometimes too high to avoid significant voltage drops as current flows from the emitters 30. As a result, the emitters 30 closer to the conductive material 22 are at a different potential than the emitters 30 farther away from the conductive material 22. The emitters 30 closer to the conductive material 22 then emit more electrons than the emitters 30 farther away from the conductive material 22. As a result, the display is non-uniformly illuminated. While this problem could be solved by extending the conductive material 22 beneath the polysilicon layer 26, thereby providing a uniform resistance between the conductive layer 22 and each emitter 30, doing so would create other problems. More specifically, positioning the conductive layer 22 substantially all of the way across the substrate 20 would result in excessive capacitances between the conductive layer 22 and the polysilicon layer 38 forming the extraction grid. Moreover, the resistance between the conductive layer 22 and each emitter 30 would be too small to provide effective current limiting. It is often desirable to provide a fairly substantial resistance between the conductive layer 22 and the emitters 30 to limit the amount of current that can flow from each emitter 30. Thus, the problem with the prior art approach is not the amount of the resistance between the conductive layer 22 and each emitter, but rather the non-uniformity of this resistance caused by the relatively high resistance of the polysilicon layer 26. Extending the conductive layer 22 beneath the emitters would limit the resistance to the resistance across a very thin layer of polysilicon material which would provide inadequate resistance to effectively limit current.

Still another problem with conventional field emission displays is false emitters that result in short circuits between column lines and row lines. With reference to FIG. 3, the metal layer 22, such as chromium, is normally deposited on the glass substrate 20 by physical vapor deposition or sputtering. Although such a technique generally provides a layer of uniform thickness, at times particles of the metal being deposited can form on the surface of the substrate 20. Also, the metal can be deposited on particles of dirt which find their way onto the surface of the substrate 20. When either of these events occur, a relatively large deposit, known as a false emitter 70, is formed on the substrate 20. The false emitter 70 extends through the first polysilicon layer 26, the oxide layer 34, and makes contact with the second polysilicon layer 38 forming the extraction grids. Under these circumstances, the column of emitters 30 connected to the metal layer 22 will be shorted to the row of extraction grids formed by the portion of the polysilicon layer 38 that is contacted by the false emitter 70.

For the above reasons, practical techniques for performing field emitter displays have resulted in less than ideal field emission displays.

SUMMARY OF THE INVENTION

In accordance with the invention, a field emission display includes a non-conductive baseplate including a non-conductive substrate having a conductive coating on at least part of its surface. A first layer of insulative material, such as a silicon oxide, is deposited on the substrate and conductive coating, with at least one gap being formed in the insulative material to expose the conductive coating. A first layer of substantially conductive material, such as polysilicon, is formed on the insulative material, and a plurality of emitters are formed on the substantially conductive material. Significantly, the substantially conductive material makes contact with the conductive coating through the gap in the first insulative layer, while the insulative material spaces the first substantially conductive layer a substantial distance from the conductive coating. A second layer of insulative material overlies a substantial portion of the layer of substantially conductive layer, and openings are formed in the insulative material around respective emitters. A third layer of substantially conductive material forming an extraction grid overlies at least a portion of the second layer of insulative material, and has formed therein respective openings surrounding the emitters. The emitters are preferably formed in rows and columns with the emitters in each column being isolated from the emitters in other columns and being coupled to a respective column line through a respective opening in the first insulative layer. Similarly, the second layer of substantially conductive material forming the extraction grid is preferably arranged in rows with the extraction grids in each row being coupled to each other and isolated from the extraction grids in other rows.

DETAILED DESCRIPTION OF THE INVENTION

Figure 4:
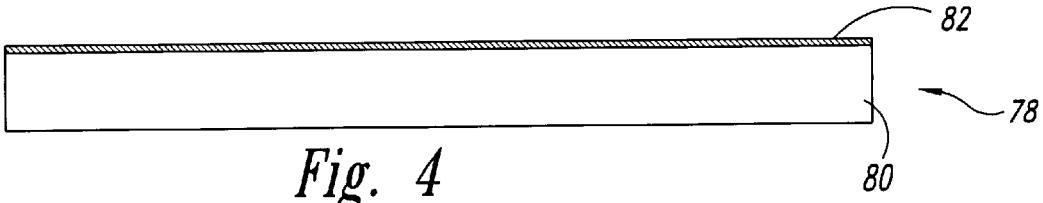
FIG. 4 is a cross-sectional view showing a first processing step or a field emission display baseplate in accordance with the present invention.
Figure 5:
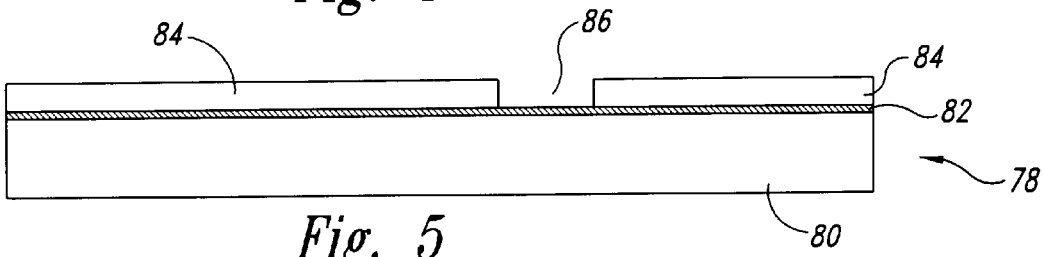
FIG. 5 is a cross-sectional view showing a second processing step for a field emission display baseplate in accordance with the present invention.
Figure 6:
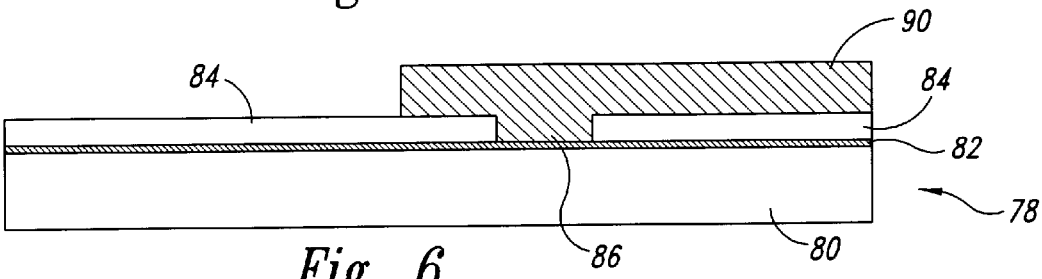
FIG. 6 is a cross-sectional view showing a third processing step for a field emission display baseplate in accordance with the present invention.
Figure 7:
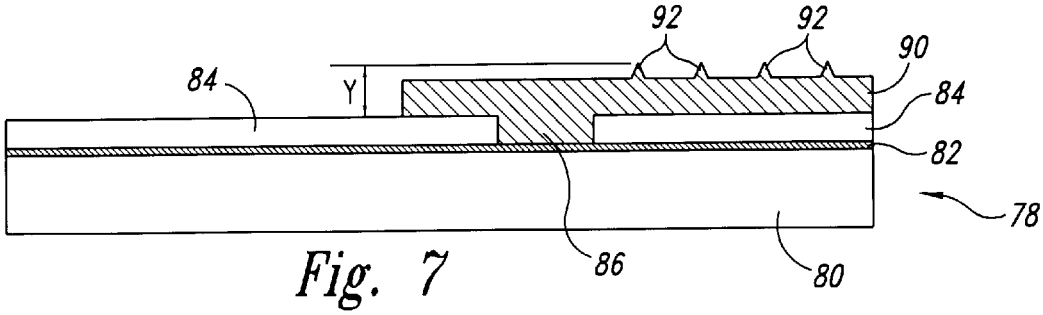
FIG. 7 is a cross-sectional view showing a fourth processing step for a field emission display baseplate in accordance with the present invention.
Figure 8:
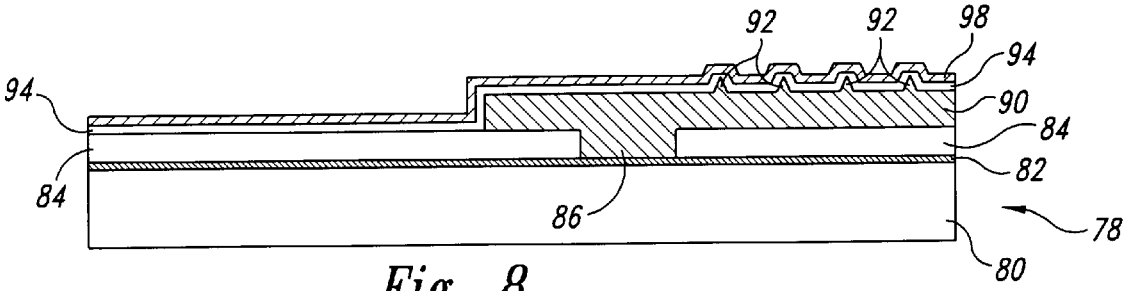
FIG. 8 is a cross-sectional view showing a fifth processing step for a field emission display baseplate in accordance with the present invention.

A process for making a first embodiment of a field emission display baseplate 78 is illustrated in FIGS. 4–9. As illustrated in FIG. 4, an insulating substrate 80, such as a glass plate, is coated with a conductive layer 82, such as a layer of metal, for example, chromium. Although the conductive layer 82 may be a layer of metal, it nevertheless has some resistivity associated with it. As illustrated in FIG. 5, the conductive layer 82 is then coated with a relatively thick oxide layer 84 except at a localized area forming a gap 86 in the oxide layer 84. The gap 86 can be formed using a variety of conventional semiconductor fabrication techniques. After the oxide layer 84 has been deposited on the conductive layer 82, a layer of polysilicon 90 is formed as illustrated in FIG. 6. The polysilicon layer 90 extends into the gap 86 in the oxide layer 84 to contact the conductive layer 82. As illustrated in FIG. 6, the polysilicon layer 90 preferably leaves a portion of the oxide layer 84 exposed. A CMP process could be used for planarization. As illustrated in FIG. 7, conical emitters 92 are then formed in the polysilicon layer 90 by suitable means, such as the method described in U.S. Pat. No. 3,970,887 which is incorporated herein by reference. Next, as illustrated in FIG. 8, a second, relatively thin layer of oxide 94 conformingly coats the emitters 92 and extends along the upper surface of the polysilicon layer 90 and first oxide layer 84. As also illustrated in FIG. 8, a relatively thin, second polysilicon layer 98 conformingly coats the second oxide layer 94 and extends along substantially the entire surface of the second oxide layer 94.

Figure 9:
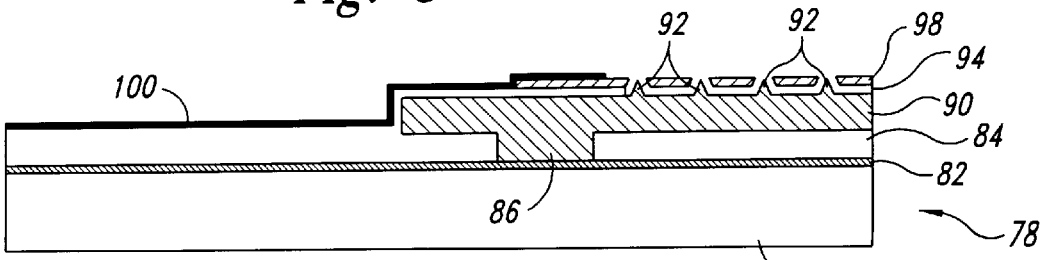
FIG. 9 is a cross-sectional view showing a sixth processing step for a field emission display baseplate in accordance with the present invention.

The final steps in the process of manufacturing a field emission display baseplate in accordance with the invention is illustrated in FIG. 9. The oxide layer 94 and the polysilicon layer around each of the emitters 92 is removed by suitable means such as the method described in U.S. Pat. No. 5,229,331, which is incorporated herein by reference. As a result, the emitters 92 are separated from the surrounding oxide layer 94 and polysilicon layer 98. The polysilicon layer 98 thus forms an extraction grid. The second polysilicon layer 98 forming the extraction grid preferably terminates adjacent the leftmost emitter 92. A second conductive layer 100 then extends from the left side of the baseplate 78 to overlie the left edge of the second polysilicon layer 98. The conductive layer 100 forms a conductor for applying a voltage to the extraction grid. Since the conductive material 100 is more conductive than the polysilicon layer 98, it is desirable in most cases for the conductive layer 100 to extend to the polysilicon layer 98 near the emitters 92. However, under some circumstances it is possible for the polysilicon layer 98 to extend significantly farther across the surface of the second oxide layer 94 and using a significantly shorter conductor formed by the conductive layer 100. Also, if the extraction grid is formed by a highly conductive material such as a metal, it is possible to eliminate the second polysilicon layer 98 and use the conductive layer 100 as the extraction grid by extending it across the emitters 92 and forming apertures in the conductive layer 100 above the respective emitters 92.

Figure 2:
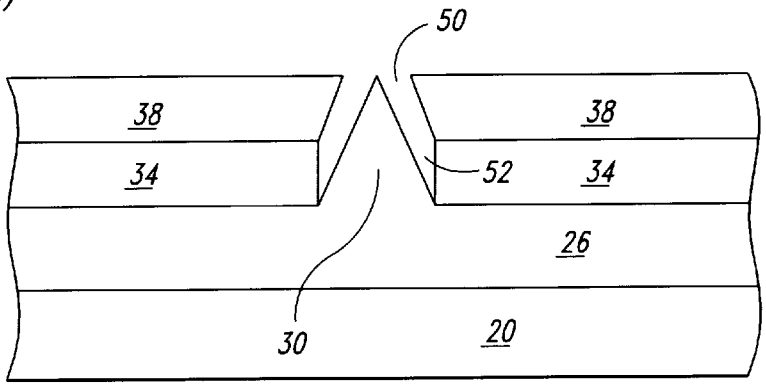
Fig. 2 (Prior Art)
FIG. 2 is a cross-sectional view of a portion of the display of FIG. 1 showing an emitter and surrounding structure.
Figure 3:
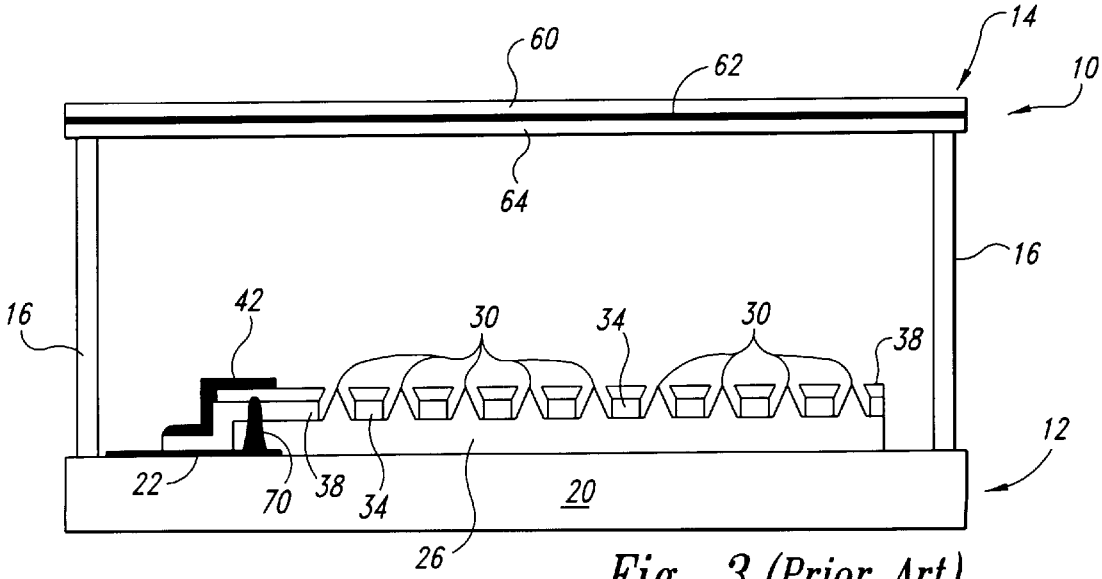
Fig. 3 (Prior Art)
FIG. 3 is a cross-sectional view of a conventional field emission display illustrating the problems resulting from a photo defect, causing the formation of a false emitter.
Figure 10:
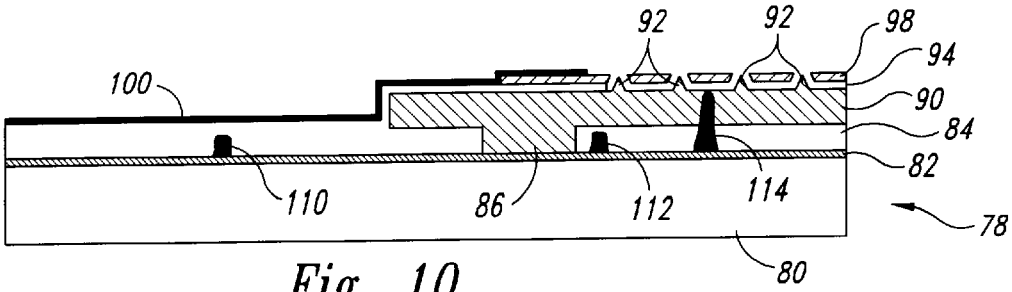
FIG. 10 is a cross-sectional view of the preferred embodiment of the inventive field emission layer display baseplate illustrating its relative immunity to false emitter problems.

There are several advantages to the field emitter baseplate 78 structure illustrated in FIG. 9. First, since the first oxide layer 84 and first polysilicon layer 90 space the second polysilicon layer 98 a significant distance from the conductive layer 82, the capacitance between the extraction grid and the conductive layer 82 is relatively small. Second, the substantial distance between the conductive layer 82 and the emitters 92 through the polysilicon layer 90 provides a relatively large resistance between the conductive layer 82 and the emitters 92. This relatively high resistance regulates the current flowing from the emitters to the conductive layer 82. Third, the relatively large capacitance between the conductive layer 82 and the first polysilicon layer 90 allows signals to be coupled from the conductive layer 82 to the emitters 92 with a relatively low time constant. Thus, despite the high resistance between the conductive layer 82 and the first polysilicon layer 90, signals can be quickly coupled from the conductive layer 82 to the emitters 92. In fact, under some circumstances the connection between the conductive layer 82 and the polysilicon layer 90 can be omitted so that signals are transferred to the emitters solely by capacitive coupling as explained in greater detail below with reference to FIG. 18. In such cases, the emitter current can be regulated by controlling the time-related characteristics of the signal since the capacitively coupled current is given by the formula $I(t)=C\ de/dt$ where C is the capacitance between the conductive layer 82 and the first polysilicon layer 90 and de/dt is the rate of change of the voltage applied to the conductive layer 82. Fourth, the inventive baseplate 78 is substantially immune to short circuits from false emitters. With reference to FIG. 10, a false emitter 110 is formed on the first conductive layer 82. The height of the false emitter 110 is relatively large, i.e., exceeding twice the height of the emitters 92. However, the relatively thick oxide layer 84, as well as the second oxide layer 94, space the second conductive layer 100 from the tip of the false emitter 110 thereby preventing the false emitter 110 from shorting the first conductive layer 82 to the second conductive layer 100. Similarly, a second false emitter 112 is formed on the conductive layer 82 beneath the first polysilicon layer 90. Once again, the substantial thickness of the first oxide layer 84 spaces the polysilicon layer 90 from the tip of the false emitter 112, thereby preventing the false emitter 112 from shorting the conductive layer 82 to the polysilicon layer 90. If a false emitter, such as the false emitter 114, was very tall, it would short to the polysilicon layer 90. As a result, the short circuit would reduce the resistance between the first conductive layer 82 and the emitters. However, the baseplate might still function because the oxide layers 84, 94 and the polysilicon layer 90 space the second polysilicon layer 98 from the tip of the false emitter 114 thereby preventing the second polysilicon layer 98 from shorting to the conductive layer 82. The preferred embodiment of the invention illustrated in FIGS. 4–10 thus avoids the problems with conventional field emission baseplate structures described above with reference to FIGS. 1–3.

Figure 11:
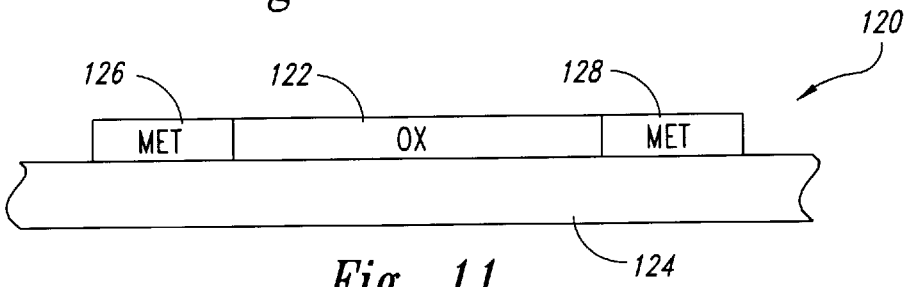
FIG. 11 is a cross-sectional view showing a first processing step for a field emission display baseplate in accordance with an alternative embodiment of the present invention.

An alternative embodiment of a baseplate structure 120 is illustrated in FIGS. 11–14. With reference to FIG. 11, an oxide layer 122 is formed on a substrate 124, such as a plate of glass, between spaced-apart layers of conductive material 126, 128 which may be a metal, such as chromium. The thickness of the layers 122, 126, 128 are preferably but not necessarily identical to each other.

Figure 12:
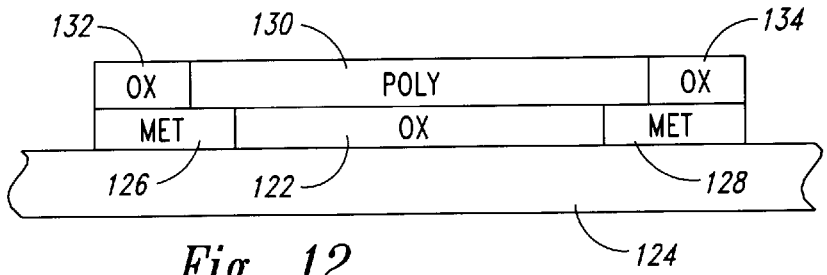
FIG. 12 is a cross-sectional view showing a second processing step for a field emission display baseplate in accordance with an alternative embodiment of the present invention.
Figure 13:
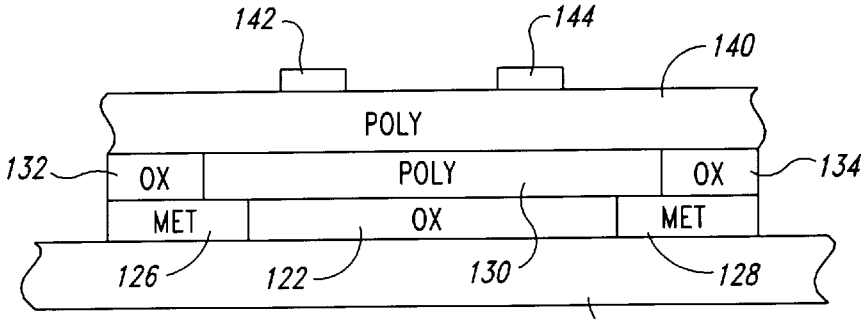
FIG. 13 is a cross-sectional view showing a third processing step for a field emission display baseplate in accordance with an alternative embodiment of the present invention.
Figure 14:
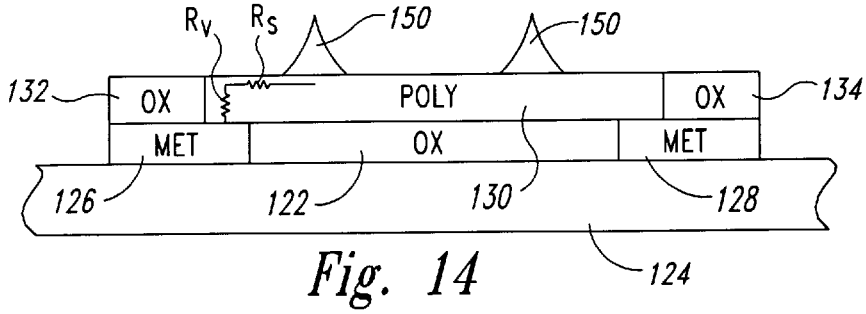
FIG. 14 is a cross-sectional view showing a fourth processing step for a field emission display baseplate in accordance with an alternative embodiment of the present invention.

Next, as illustrated in FIG. 12, a layer of polysilicon 130 is deposited over the oxide layer 122 and at least a portion of one of the conductive layers 126, 128. Second oxide layers 132, 134 are then formed on opposite sides of the polysilicon layer 130. As illustrated in FIG. 13, a second polysilicon layer 140 is then deposited over the first polysilicon layer 130 and second oxide layers 132, 134. As explained below, the second polysilicon layer 140 is used to form emitters by suitable means. One technique for forming emitters is to deposit oxide or nitride layers 142, 144 over localized areas of the second polysilicon layer 140 where emitters are to be formed. The second polysilicon layer 140 is then selectively removed to form the emitters 150, as illustrated in FIG. 14. Another oxide layer (not shown) and another polysilicon layer (not shown) are subsequently deposited to form the extraction grid as explained above with reference to FIGS. 4–9.

Figure 15:
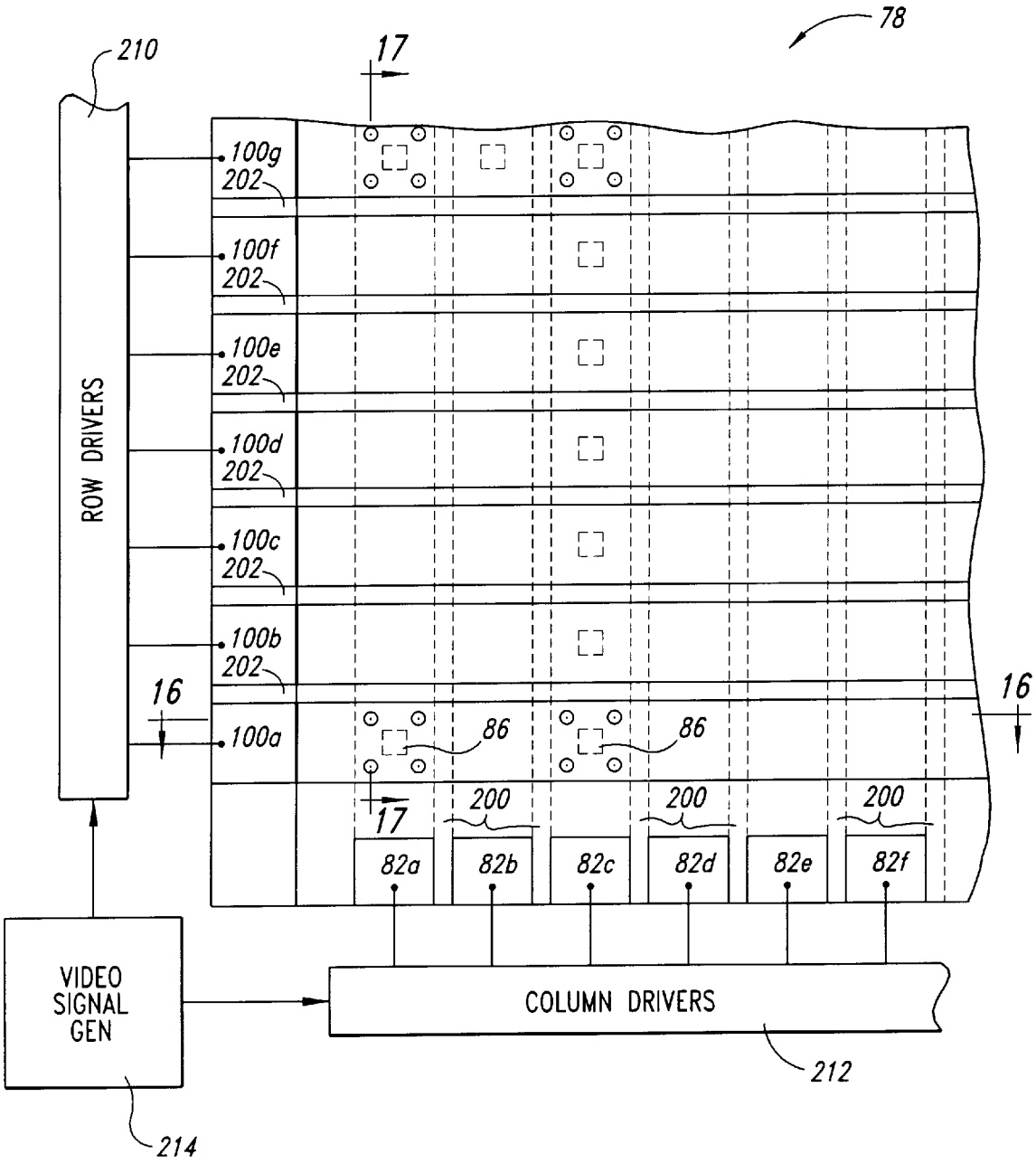
FIG. 15 is a plan view of the preferred embodiment of the inventive field emission display baseplate.
Figure 16:
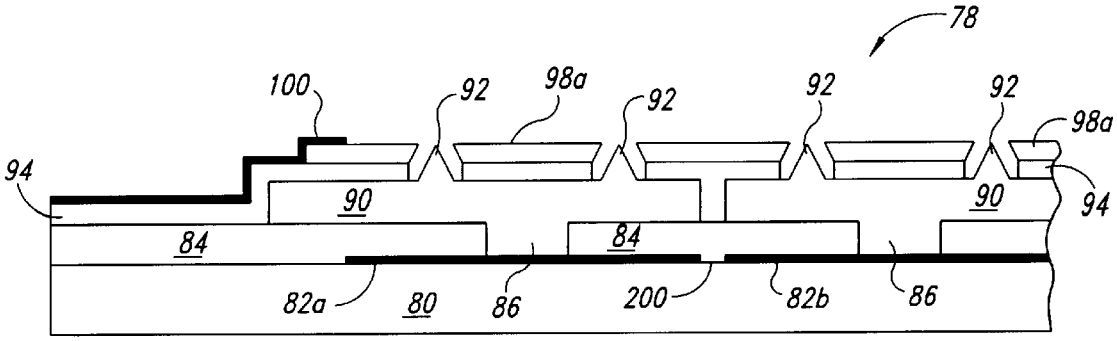
FIG. 16 is a cross-sectional view taken along the line 16—16 of FIG. 15.
Figure 17:
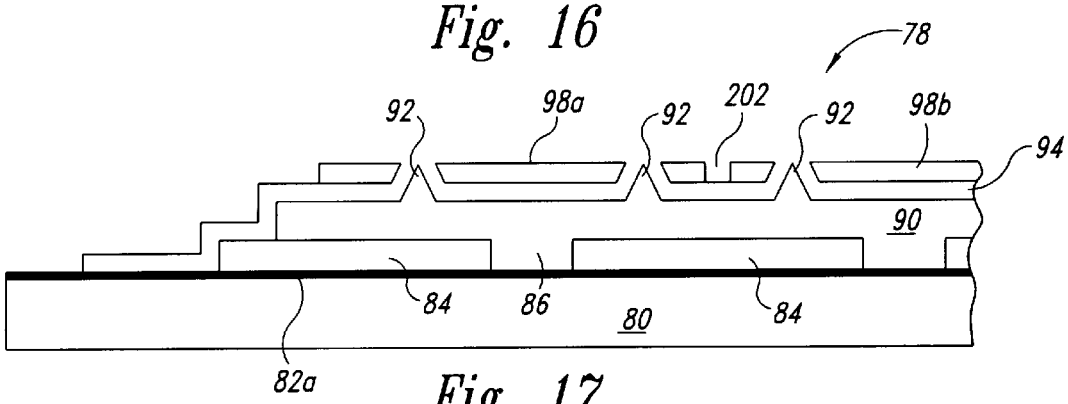
FIG. 17 is a cross-sectional view taken along the line 17–7 of FIG. 15.

A complete field emission display baseplate 78 fabricated in accordance with the method of FIGS. 4–9 is illustrated in FIGS. 15–17. FIG. 16 is a cross-sectional view illustrating the manner in which the conductive layer 82 is divided into column lines 82*a, b* separated from each other by a gap 200. FIG. 17 is a cross-sectional view illustrating the manner in which the polysilicon layer 98 forming the extraction grid is separated into row lines 98*a, b* by respective gaps 202. As best illustrated in FIG. 15, each pixel of the display includes an emitter set consisting of a large number of emitters (represented in FIGS. 15–17 by four emitters 92 symmetrically positioned about a square gap 86 in the first oxide layer 84). The polysilicon layer 90 makes contact with a respective column line 82*a–f* through the gap 86 in the oxide layer 84, as illustrated in FIGS. 16 and 17.

Each of the row lines 100*a–g* is connected to a respective line of a conventional set of row drivers 210 while each of the column lines 82*a–f* are connected to a respective line of a conventional set of column drivers 212. The row drivers 210 and column drivers 212 receive signals from a conventional video signal generator 214. The video signal generator 214 may be, for example, a television receiver, a computer, a camcorder, a VCR, etc. Basically, the row drivers apply a positive signal on the order of 30 to 100 volts to each of the row lines 100*a–g* in sequence. The column drivers 212 sequentially drive each of the column lines 82*a–f* with a voltage of between 0 and −30 volts during the energization of each row line 100*a–g*. Thus, for example, the row drivers 210 apply a signal to the row line 100*a,* and the column drivers 212 then sequentially apply an appropriate signal to each of the column lines 82*a–f*. The row drivers 210 then apply a signal to the row line 100*b,* and the column drivers 212 sequentially apply a signal to each of the column lines 82*a–f*. By controlling the amplitude of the signals output by the row drivers 210 and the column drivers 212, the intensity of the illumination of each emitter set can be precisely controlled in a conventional manner.

Figure 1:
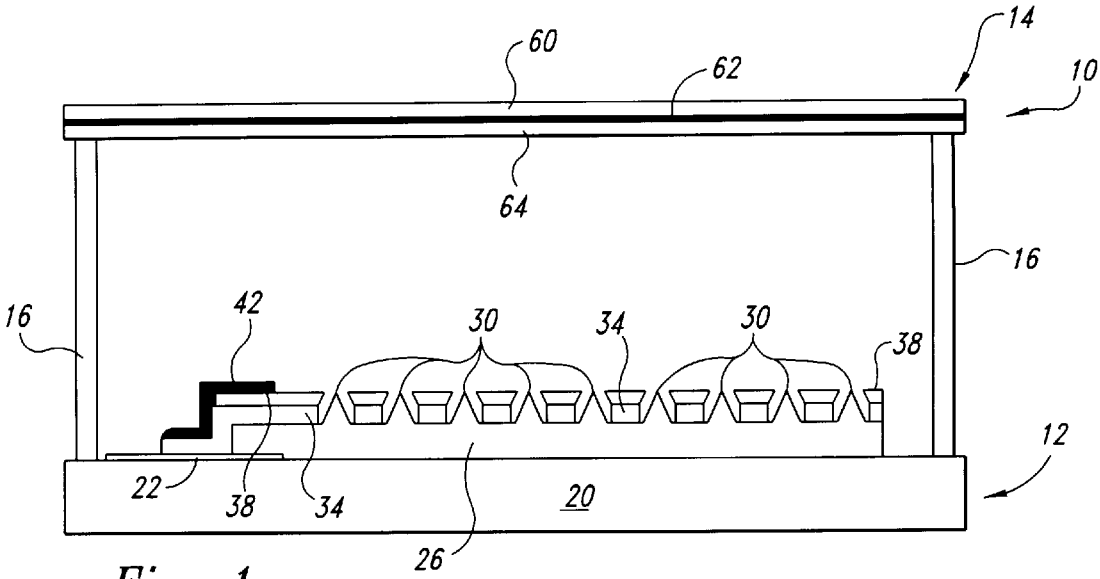
Fig. 1 (Prior Art)
FIG. 1 is a cross-sectional view of a conventional field emission display.

The baseplate 78 illustrated in FIGS. 15–17 can be used in place of the conventional baseplate 12 illustrated in FIG. 1. However, for purposes of brevity, the structural relationship and interaction between the baseplate 78 and the faceplate 14 will not be repeated since the faceplate 14 works in the same manner with the inventive baseplate 78.

Figure 18:
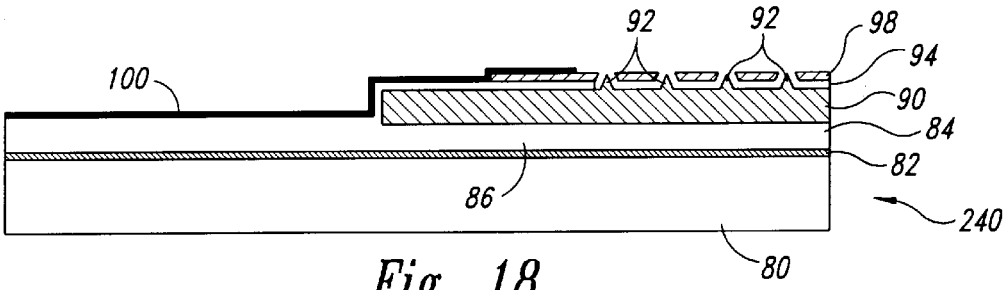
FIG. 18 is a cross-sectional view of an alternative embodiment of the inventive field emission display baseplate.

Still another embodiment of the invention is illustrated in FIG. 18. A field emission display baseplate 240 as shown in FIG. 18 is very similar to the baseplate 78 illustrated in FIG. 9 and fabricated as explained above with reference to FIGS. 4–9. Thus, in the interest of brevity, the components of the baseplate 240 have been provided with the same reference numeral as in FIGS. 4–9, and a description of the structure and fabrication of the baseplate 240 will not be repeated. The baseplate 240 shown in FIG. 18 differs from the baseplate 78 shown in FIGS. 4–9 in that a gap 86 (FIG. 9) is not formed in the relatively thick oxide layer 84. As a result, the a layer of polysilicon 90 does not extend into the gap 86 in the oxide layer 84 to contact the conductive layer 82. Therefore, there is no resistive path between the conductive layer 82 and the emitters 92. Instead, all of the electrical coupling between the conductive layer 82 and the emitters 92 is by capacitive coupling. The capacitive coupling is through a capacitor formed by the electrically conductive layers 90, 92 spaced apart by the insulative oxide layer 84. As a result, as mentioned above, the emitter current can be regulated by controlling the time-related characteristics of the signal, and the emitter current is given by the formula $I(t)=C\ de/dt$ where C is the capacitance between the conductive layer 82 and the polysilicon layer 90 and de/dt is the rate of change of the voltage applied to the conductive layer 82.

Figure 19:
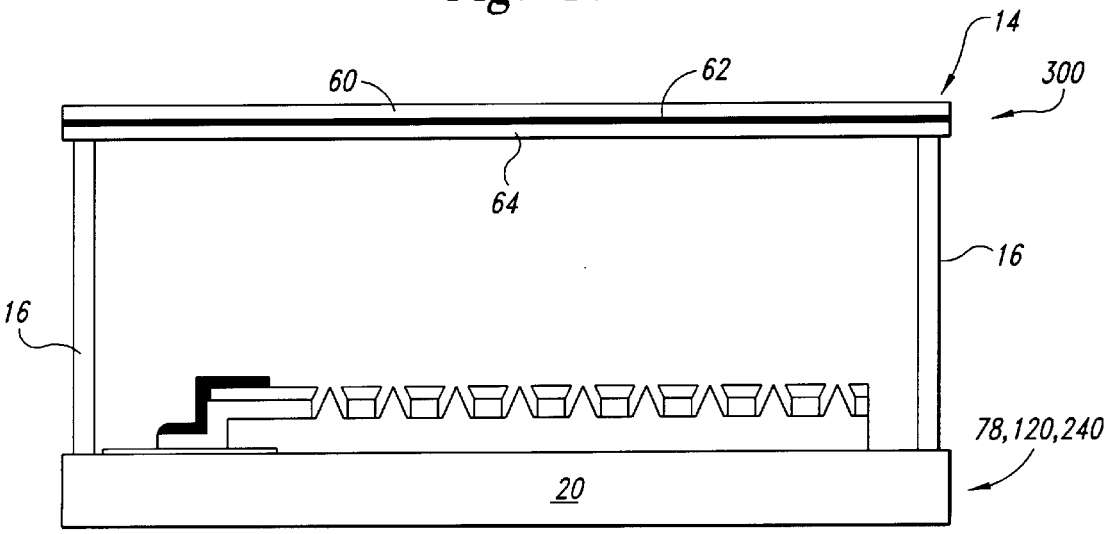
FIG. 19 is a cross-sectional view of a field emission display in accordance with one embodiment of the invention.

One embodiment of a field emission display 300 is shown in FIG. 19, in which the reference numerals correspond to the reference numerals used in other figures for the same components. As shown therein, the field emission display 300 includes a viewing screen 14 supported on a baseplate 78, 120 or 240 by a mounting structure in the form of spacers 16.

It will be appreciated that, although specific embodiments of the invention have been described herein for purposes of illustration, various modifications may be made without departing from the spirit and scope of the invention. Accordingly, the invention is not limited except as by the appended claims.

What is claimed is:

1. A field emission display baseplate, comprising:

a substrate having a generally planar working surface;

a first layer of generally conductive material coating at least a portion of the working surface of said substrate, said first layer of generally conductive material having a first conductivity;

a first layer of generally insulative material overlying at least a portion of said first layer of generally conductive material, said first layer of insulative material has an opening formed therein over said first layer of generally conductive material to expose said first layer of generally conductive material through said opening;

a second layer of generally conductive material overlying at least a portion of said first layer of insulative material including said opening, said second layer of generally conductive material extends into said opening to contact said first layer of generally conductive material, said second layer of generally conductive material having a surface on which at least one emitter is formed, said second layer of generally conductive material having a second conductivity that is less than said first conductivity;

a second layer of generally insulative material overlying a substantial portion of said second layer of generally conductive material, said second layer of generally insulative material having formed an opening surrounding said emitter; and a third layer of generally conductive material overlying at least a portion of said second layer of generally insulative material, said third layer of generally conductive material having formed therein an opening surrounding said emitter, said third layer of generally conductive material forming an extraction grid for said field emission display baseplate.

2. The field emission display baseplate of claim 1 wherein said substrate comprises a sheet of glass.

3. The field emission display baseplate of claim 1 wherein said first layer of generally conductive material comprises a layer of a metal.

4. The field emission display baseplate of claim 3 wherein said metal comprises chromium.

5. The field emission display baseplate of claim 1 wherein said second and third layers of generally conductive material comprises respective layers of a polysilicon material.

6. The field emission display baseplate of claim 1 wherein said first and second layers of generally insulative material comprises respective layers of a silicon oxide material.

7. A field emission display baseplate, comprising:

a substrate;

a first generally conductive layer formed on at least a portion of said substrate, said first generally conductive layer being formed of a material having a first conductivity;

a generally insulative layer overlying at least a portion of said first conductive layer, said first insulative layer having at least one opening formed therein over said first conductive layer to expose said first conductive layer through said opening;

a second generally conductive layer overlying at least a portion of said insulative layer, said second generally conductive layer being formed of a material having a second conductivity that is less than said first conductivity;

an electrical contact coupling said first and second conductive layers to each other through the at least one opening formed in said generally insulative layer; and at least one emitter in electrical contact with said second conductive layer.

8. The field emission display baseplate of claim 7 wherein said substrate comprises a sheet of glass.

9. The field emission display baseplate of claim 7 wherein said first layer of generally conductive material comprises a layer of a metal.

10. The field emission display baseplate of claim 9 wherein said metal comprises chromium.

11. The field emission display baseplate of claim 7 wherein said second generally conductive layer comprises a layer of a polysilicon material.

12. The field emission display baseplate of claim 7 wherein said generally insulative layer comprises a layer of a silicon oxide material.

13. The field emission display baseplate of claim 7 wherein said second generally conductive layer is formed directly on said insulative layer.

14. The field emission display baseplate of claim 7 wherein said emitter is formed on said second conductive layer.

15. The field emission display baseplate of claim 7 wherein said electrical contact coupling said first and second conductive layers to each other comprises a portion of said second generally conductive layer extending into the at least one opening formed in said generally insulative layer and making contact with said first conductive layer.

16. A field emission display baseplate, comprising:

a substrate having a generally planar working surface;

a first layer of generally conductive material coating at least a portion of the working surface of said substrate, said first layer of generally conductive material having a first conductivity;

a first layer of generally insulative material overlying at least a portion of said first layer of generally conductive material;

a second layer of generally conductive material overlying at least a portion of said first layer of generally insulative material, said second layer of generally conductive material having a surface on which at least one emitter is formed, said second layer of generally conductive material being capacitively coupled to said first layer of generally conductive material through said first layer of generally insulative material, said second layer of generally conductive material having a second conductivity that is less than said first conductivity;

a second layer of generally insulative material overlying a substantial portion of said second layer of generally conductive material, said second layer of generally insulative material having formed an opening surrounding said emitter; and a third layer of generally conductive material overlying at least a portion of said second layer of generally insulative material, said third layer of generally conductive material having formed therein an opening surrounding said emitter, said third layer of generally conductive material forming an extraction grid for said field emission display baseplate.

17. The field emission display baseplate of claim 16 wherein said first layer of generally insulative material has an opening formed therein over said first layer of generally conductive material to expose said first layer of generally conductive material through said opening and said second layer of generally conductive material extends into said opening to contact said first layer of generally conductive material thereby resistively coupling said second layer of generally conductive material to said first layer of generally conductive material.

18. The field emission display baseplate of claim 16 wherein said substrate comprises a sheet of glass.

19. The field emission display baseplate of claim 16 wherein said first layer of generally conductive material comprises a layer of a metal.

20. The field emission display baseplate of claim 19 wherein said metal comprises chromium.

21. The field emission display baseplate of claim 16 wherein said second and third layers of generally conductive material comprises respective layers of a polysilicon material.

22. The field emission display baseplate of claim 16 wherein said first and second layers of generally insulative material comprises respective layers of a silicon oxide material.

23. A field emission display baseplate, comprising:

a non-conductive substrate having a generally rectangular, generally planar working surface;

a first layer of metal coating at least a portion of the working surface of said substrate, said first metal layer forming a plurality of column lines extending along a substantial portion of the working surface of said substrate, said first layer of metal having a first conductivity;

a first oxide layer overlying at least a substantial portion of said column lines and at least a portion of the working surface of said substrate, said first oxide layer having respective openings formed therein over a plurality of said column lines to expose said column lines through said openings;

a first layer of polysilicon material overlying at least a portion of said first oxide layer including said openings, said first polysilicon layer extending into said openings to contact said column lines, said first polysilicon layer having a surface on which a plurality of emitters are formed in rows and columns with the emitters in one column being isolated from the emitters in other columns and the emitters in each column being coupled to a respective column line through a respective opening in said first oxide layer said polysilicon material having a conductivity that is less than said first conductivity;

a second oxide layer overlying a substantial portion of said first polysilicon layer, said second oxide layer having formed therein respective openings surrounding a plurality of said emitters; and a layer of generally conductive material overlying at least a portion of said second oxide layer, said layer of conductive material having formed therein respective openings surrounding a plurality of said emitters, said layer of conductive material forming an extraction grid for said field emission display baseplate with the extraction grids in each row being coupled to each other and isolated from the extraction grids in other rows.

24. The field emission display baseplate of claim 23 wherein said layer of conductive material comprises a second layer of polysilicon material; and wherein said field emission display baseplate further comprises a second layer of metal forming a plurality of row lines deposited on said second polysilicon layer and extending along a substantial portion of said second polysilicon layer, said row lines being isolated from each other and being coupled to respective portions of said second polysilicon layer forming the extraction grids in each row.

25. The field emission display baseplate of claim 23 wherein said layer of conductive material comprises a second layer of metal forming said extraction grids, a plurality of row lines extending along a substantial portion of said second oxide layer, said row lines being isolated from each other so that the extraction grids in each row are coupled to each other and isolated from the extraction grids of other rows.

26. The field emission display baseplate of claim 23 wherein said substrate comprises a sheet of glass.

27. The field emission display baseplate of claim 23 wherein said first metal layer comprises a layer of chromium.

28. The field emission display baseplate of claim 23 wherein said first and second oxide layers comprises respective layers of a silicon oxide.

29. A field emission display, comprising:

a viewing screen, comprising:

a generally planar, transparent panel having a generally planar surface;

a layer of generally transparent conductive material coating the generally planar surface of said transparent panel to form an anode; and a layer of cathodoluminescent material coating said anode;

a baseplate, comprising:

a substrate;

a first generally conductive layer formed on at least a portion of said substrate, said first generally conductive layer being formed of a material having a first conductivity;

a generally insulative layer overlying at least a portion of said first conductive layer, said first insulative layer having at least one opening formed therein over said first conductive layer to expose said first conductive layer through said opening;

a second generally conductive layer overlying at least a portion of said insulative layer, said second generally conductive layer being formed of a material having a second conductivity that is less than said first conductivity;

an electrical contact coupling said first and second conductive layers to each other through the at least one opening formed in said generally insulative layer; and at least one emitter in electrical contact with said second conductive layer; and a mounting structure connected to said baseplate and said viewing screen, said mounting structure positioning said viewing screen a fixed distance from said substrate.

30. The field emission display of claim 29 wherein said electrical contact coupling said first and second generally conductive layers to each other comprises a portion of said second generally conductive layer extending into the at least one opening formed in said generally insulative layer and making contact with said first generally conductive layer.

31. The field emission display of claim 29 wherein said substrate comprises a sheet of glass.

32. The field emission display of claim 29 wherein said first generally conductive layer comprises a layer of a metal.

33. The field emission display of claim 32 wherein said metal comprises chromium.

34. The field emission display of claim 29 wherein said second generally conductive layer comprises a layer of a polysilicon material.

35. The field emission display of claim 29 wherein said generally insulative layer comprises a layer of a silicon oxide material.

36. The field emission display baseplate of claim 29 wherein said second generally conductive layer is formed directly on said insulative layer.

37. The field emission display of claim 29 wherein said emitter is formed on said second conductive layer.

38. A field emission display, comprising:

a viewing screen, comprising:

a generally planar, transparent panel having a generally planar surface;

a layer of generally transparent conductive material coating the generally planar surface of said transparent panel to form an anode; and a layer of cathodoluminescent material coating said anode;

a baseplate, comprising:

a substrate;

a first generally conductive layer formed on at least a portion of said substrate, said first generally conductive layer being formed of a material having a first conductivity;

a generally insulative layer overlying at least a portion of said first conductive layer;

a second generally conductive layer overlying at least a portion of said insulative layer, said second generally conductive layer being capacitively coupled to said first generally conductive layer through said generally insulative layer, said second generally conductive layer being formed of a material having a second conductivity that is less than said first conductivity; and at least one emitter in electrical contact with said second conductive layer; and a mounting structure connected to said baseplate and said viewing screen, said mounting structure positioning said viewing screen a fixed distance from said substrate.

39. The field emission display of claim 38 wherein said generally insulative layer has at least one opening formed therein over said first generally conductive layer to expose said first generally conductive layer through said opening, and wherein said second generally conductive layer extends into said opening to contact said first generally conductive layer thereby resistively coupling said second generally conductive layer to said first generally conductive layer.

40. The field emission display of claim 39 wherein said substrate comprises a sheet of glass.

41. The field emission display of claim 38 wherein said first generally conductive layer comprises a layer of a metal.

42. The field emission display of claim 41 wherein said metal comprises chromium.

43. The field emission display of claim 38 wherein said second generally conductive layer comprises a layer of a polysilicon material.

44. The field emission display of claim 40 wherein said generally insulative layer comprises a layer of a silicon oxide material.

45. The field emission display baseplate of claim 38 wherein said second generally conductive layer is formed directly on said generally insulative layer.

46. The field emission display of claim 38 wherein said emitter is formed on said second generally conductive layer.

47. A field emission display, comprising:

a viewing screen, comprising:

a generally planar, transparent panel having a generally planar surface;

a layer of generally transparent conductive material coating the generally planar surface of said transparent panel to form an anode; and a layer of cathodoluminescent material coating said anode;

a baseplate, comprising:

a generally planar substrate positioned in parallel with said viewing screen, said substrate having a generally planar working surface facing said anode;

a first layer of generally conductive material coating at least a portion of the working surface of said substrate, said first layer of generally conductive material having a first conductivity;

a first layer of generally insulative material overlying at least a portion of said first layer of generally conductive material, said first layer of generally insulative material having an opening formed therein over said first layer of generally conductive material to expose said first layer of generally conductive material through said opening;

a second layer of generally conductive material overlying at least a portion of said first layer of generally insulative material including said opening, said second layer of generally conductive material extending into said opening to contact said first layer of generally conductive material, said second layer of generally conductive material having a surface on which at least one emitter is formed, said second layer of generally conductive material having a second conductivity that is less that said first conductivity;

a second layer of generally insulative material overlying a substantial portion of said second layer of generally conductive material, said second layer of generally insulative material having formed therein an opening surrounding said emitter; and a third layer of generally conductive material overlying at least a portion of said second layer of generally insulative material, said third layer of generally conductive material having formed therein an opening surrounding said emitter, said third layer of generally conductive material forming an extraction grid for said field emission display baseplate; and a mounting structure connected to said baseplate and said viewing screen, said mounting structure positioning said viewing screen a fixed distance from said substrate.

48. The field emission display of claim 47 wherein said substrate comprises a sheet of glass.

49. The field emission display of claim 47 wherein said first layer of generally conductive material comprises a layer of a metal.

50. The field emission display of claim 49 wherein said metal comprises chromium.

51. The field emission display of claim 47 wherein said second and third layers of generally conductive material comprises respective layers of a polysilicon material.

52. The field emission display of claim 47 wherein said first and second layers of generally insulative material comprises respective layers of a silicon oxide material.

53. A field emission display, comprising:

a viewing screen, comprising:

a generally planar, transparent panel having a generally planar surface;

a layer of generally transparent conductive material coating the generally planar surface of said transparent panel to form an anode; and a layer of cathodoluminescent material coating said anode;

a baseplate, comprising:

a generally planar substrate positioned in parallel with said viewing screen;;

a first generally conductive layer formed on at least a portion of said substrate; said layer of generally conductive material forming a plurality of column lines extending along a substantial portion of the working surface of said substrate with the column lines being electrically isolated from each other, said first generally conductive layer having a first conductivity;

a generally insulative layer overlying at least a portion of said first generally conductive layer, said generally insulative layer having respective openings formed therein over a plurality of said column lines to expose said column lines through said openings;

a second generally conductive layer overlying at least a portion of said generally insulative layer, said second generally conductive layer forming a plurality of column lines that are electrically isolated from each other, said second generally conductive layer having a second conductivity that is less than said first conductivity;

an electrical contact coupling at least some of the column lines in said first generally conductive layer to a respective column line in said second generally conductive layers through a respective opening formed in said generally insulative layer; and a plurality of emitters are in electrical contact with each of the column lines of said second generally conductive layer, the emitters of all of said column lines being arranged in an array of rows and columns; and a mounting structure connected to said baseplate and said viewing screen, said mounting structure positioning said viewing screen a fixed distance from said substrate.

54. The field emission display of claim 53 wherein said substrate comprises a sheet of glass.

55. The field emission display of claim 53 wherein said first layer of generally conductive material comprises a layer of a metal.

56. The field emission display of claim 55 wherein said metal comprises chromium.

57. The field emission display of claim 53 wherein said second generally conductive layer comprises a layer of a polysilicon material.

58. The field emission display of claim 53 wherein said generally insulative layer comprises a layer of a silicon oxide material.

59. The field emission display baseplate of claim 53 wherein said second generally conductive layer is formed directly on said generally insulative layer.

60. The field emission display of claim 53 wherein said emitter is formed on said second generally conductive layer.

61. The field emission display of claim 53 wherein said electrical contacts coupling at least some of said column lines of said first generally conductive layer to respective column lines of said second generally conductive layer comprises portions of said second generally conductive layer extending into respective openings formed in said first generally insulative layer and making contact with respective column lines of said first generally conductive layer.

62. An electronic system for providing a visible image to a user, said electronic system comprising:

a video signal generator generating a video signal corresponding to said image, row and column drivers receiving said video signal from said video signal generator, said row and column drivers generating respective sets of row and column signals with each set of column signals corresponding to the modulation of the video signal during each line of the video signal and each set of row signal corresponding to a respective line of the video signal; and a field emission display coupled to said row and column drivers, said field emission display comprising:

a viewing screen, comprising:

a generally planar, transparent panel having a generally planar surface;

a layer of generally transparent conductive material coating the generally planar surface of said transparent panel to form an anode; and a layer of cathodoluminescent material coating said anode;

a baseplate, comprising:

a generally planar substrate positioned in parallel with said viewing screen, said substrate having a generally planar working surface facing said anode;

a first layer of generally conductive material coating at least a portion of the working surface of said substrate, said layer of generally conductive material forming a plurality of column lines extending along a substantial portion of the working surface of said substrate with the column lines being electrically isolated from each other and connected to respective outputs of said column drivers said first layer of generally conductive material having a first conductivity;

a first layer of generally insulative material overlying at least a portion of said first layer of generally conductive material, said first layer of generally insulative material having respective openings formed therein over a plurality of said column lines to expose said column lines through said openings;

a second layer of generally conductive material overlying at least a portion of said first layer of generally insulative material including said openings, said second layer of generally conductive material forming a plurality of column lines that are electrically isolated from each other and extend into respective openings in said layer of generally insulative material to contact respective column lines of said first layer of generally conductive material, said second layer of generally conductive material having a surface on which a plurality of emitters are formed, said second layer of generally conductive material having a conductivity that is less than the first conductivity;

a second layer of generally insulative material overlying a substantial portion of said second layer of generally conductive material, said second layer of generally insulative material having formed therein respective openings surrounding a plurality of said emitters; and a third layer of generally conductive material overlying at least a portion of said second layer of generally insulative material, said third layer of generally conductive material having formed therein respective openings surrounding a plurality of said emitters, said third layer of generally conductive material forming a plurality of rows of extraction grids for said field emission display baseplate with the extraction grids in each row being coupled to each other and to a respective output of said row driver and isolated from other rows of extraction grids; and a mounting structure connected to said baseplate and said viewing screen, said mounting structure positioning said viewing screen a fixed distance from said substrate.

63. The electronic system of claim 62 wherein said video signal generator comprises a computer generating a video signal corresponding to information generated by said computer.

64. The electronic system of claim 62 wherein said video signal generator comprises a television tuner for receiving an RF television signal and generating a video signal corresponding thereto.

65. The electronic system of claim 62 wherein said video signal generator comprises a video camera for generating a video signal corresponding to an visible image being viewed by said video camera.

66. The electronic system of claim 62 wherein said substrate comprises a sheet of glass.

67. The electronic system of claim 62 wherein said first layer of generally conductive material comprises a layer of a metal.

68. The electronic system of claim 67 wherein said metal comprises chromium.

69. The electronic system of claim 62 wherein said second and third layers of generally substantially conductive material comprises respective layers of a polysilicon material.

70. The electronic system of claim 62 wherein said first and second layers of generally insulative material comprises respective layers of a silicon oxide material.

71. An electronic system for providing a visible image to a user, said electronic system comprising:

a video signal generator generating a video signal corresponding to said image, row and column drivers receiving said video signal from said video signal generator, said row and column drivers generating respective sets of row and column signals with each set of column signals corresponding to the modulation of the video signal during each line of the video signal and each set of row signal corresponding to a respective line of the video signal; and a field emission display coupled to said row and column drivers, said field emission display comprising:

a viewing screen, comprising:

a generally planar, transparent panel having a generally planar surface;

a layer of generally transparent conductive material coating the generally planar surface of said transparent panel to form an anode; and a layer of cathodoluminescent material coating said anode;

a baseplate, comprising:

a generally planar substrate positioned in parallel with said viewing screen, said substrate having a generally planar working surface facing said anode;

a first layer of generally conductive material coating at least a portion of the working surface of said substrate, said layer of generally conductive material forming a plurality of column lines extending along a substantial portion of the working surface of said substrate with the column lines being electrically isolated from each other and connected to respective outputs of said column drivers, said first layer of generally conductive material having a first conductivity;

a first layer of generally insulative material overlying at least a portion of said first layer of generally conductive material;

a second layer of generally conductive material overlying at least a portion of said first layer of generally insulative material, said second layer of generally conductive material forming a plurality of column lines that are electrically isolated from each other and capacitively coupled to said first layer of generally conductive material through said first layer of generally insulative material, said second layer of generally conductive material having a surface on which a plurality of emitters are formed, said second layer of generally conductive material having a second conductivity that is less than said first conductivity;

a second layer of generally insulative material overlying a substantial portion of said second layer of generally conductive material, said second layer of generally insulative material having formed therein respective openings surrounding a plurality of said emitters; and a third layer of generally conductive material overlying at least a portion of said second layer of generally insulative material, said third layer of generally conductive material having formed therein respective openings surrounding a plurality of said emitters, said third layer of generally conductive material forming a plurality of rows of extraction grids for said field emission display baseplate with the extraction grids in each row being coupled to each other and to a respective output of said row driver and isolated from other rows of extraction grids; and a mounting structure connected to said baseplate and said viewing screen, said mounting structure positioning said viewing screen a fixed distance from said substrate.

72. The electronic system of claim 71 wherein said first layer of generally insulative material has respective openings formed therein over a plurality of said column lines to expose said column lines through said openings, and wherein said second layer of generally conductive material extend into respective openings in said layer of generally insulative material to contact respective column lines of said first layer of generally conductive material thereby resistively coupling said second layer of generally conductive material to respective column lines of said first layer of generally conductive material.

73. The electronic system of claim 71 wherein said video signal generator comprises a computer generating a video signal corresponding to information generated by said computer.

74. The electronic system of claim 71 wherein said video signal generator comprises a television tuner for receiving an RF television signal and generating a video signal corresponding thereto.

75. The electronic system of claim 71 wherein said video signal generator comprises a video camera for generating a video signal corresponding to an visible image being viewed by said video camera.

76. The electronic system of claim 71 wherein said substrate comprises a sheet of glass.

77. The electronic system of claim 71 wherein said first layer of generally conductive material comprises a layer of a metal.

78. The electronic system of claim 77 wherein said metal comprises chromium.

79. The electronic system of claim 71 wherein said second and third layers of generally substantially conductive material comprises respective layers of a polysilicon material.

80. The electronic system of claim 71 wherein said first and second layers of generally insulative material comprises respective layers of a silicon oxide material.

81. A method of making a baseplate for a field emission display, comprising:

providing a substrate having a generally planar working surface;

forming a first layer of generally conductive material on at least a portion of the working surface of said substrate, said first layer of generally conductive material having a first conductivity;

forming a first layer of generally insulative material on at least a portion of said first layer of generally conductive material;

forming a second layer of generally conductive material on at least a portion of said first layer of generally insulative material, said second layer of generally conductive material having a second conductivity that is less than said first conductivity;

forming a plurality of emitters on said second layer of generally conductive material;

forming a second layer of generally insulative material on a substantial portion of said second layer of generally conductive material;

forming a plurality of openings in said second layer of generally insulative material surrounding a respective plurality of said emitters;

forming a third layer of generally conductive material on at least a portion of said second layer of generally insulative material; and forming a plurality of openings in said third layer of generally conductive material surrounding a respective plurality of said emitters, said third layer of generally conductive material forming an extraction grid for said field emission display baseplate.

82. The method of claim 81 wherein said step of depositing said first layer of insulative material further comprises forming an opening in said first layer of generally insulative material over said first layer of generally conductive material to expose said first layer of generally conductive material through said opening, and wherein said step of forming a second layer of generally conductive material on at least a portion of said first layer of generally insulative material further comprises allowing said second layer of generally conductive material to extend into said opening to contact said first layer of generally conductive material.

83. The method of claim 81 wherein said substrate comprises a sheet of glass.

84. The method of claim 81 wherein said step of forming said first layer of generally conductive material on said substrate comprises depositing a layer of a metal on said substrate.

85. The method of claim 84 wherein said step of forming a layer of a metal on said substrate comprises depositing a layer of chromium on said substrate.

86. The method of claim 81 wherein said steps of forming second and third layers of generally conductive material comprises depositing respective layers of a polysilicon material.

87. The method of claim 81 wherein said step of forming first and second layers of insulative material comprises depositing respective layers of a silicon oxide.

88. A method of making a baseplate for a field emission display, comprising:

providing a generally planar substrate;

forming a first generally conductive layer on said substrate, said first generally conductive layer being a material having a first conductivity;

forming a generally insulative layer over a portion of said first generally conductive layer, said generally insulative layer defining at least one opening therein;

forming a second generally conductive layer in spaced, generally parallel relationship to said first generally conductive layer, said second generally conductive layer being a material having a second conductivity that is less than said first conductivity;

forming an electrical contact at least partially within said opening, said contact electrically coupling said first and second generally conductive layers to each other; and forming at least one emitter in electrical contact with said second generally conductive layer.

89. The method of claim 88 wherein said substrate comprises a sheet of glass.

90. The method of claim 88 wherein said step of forming said first generally conductive layer on said substrate comprises depositing a layer of a metal on said substrate.

91. The method of claim 90 wherein said step of depositing a layer of a metal on said substrate comprises depositing a layer of chromium on said substrate.

92. The method of claim 88 wherein said steps of forming said second generally conductive layer comprises depositing a layers of a polysilicon material.

93. The method of claim 88 wherein said step of forming said generally insulative layer comprises depositing a layers of a silicon oxide.

94. The method of claim 88 wherein said step of forming said second generally conductive layer comprises forming said second generally conductive layer directly on said insulative layer.

95. The method of claim 88 wherein said step of forming at least one emitter in electrical contact with said second generally conductive layer comprises forming said emitter directly on said second generally conductive layer.

96. The method of claim 88 wherein said step of forming an electrical contact at least partially within said opening, to couple said first and second generally conductive layers to each other comprises allowing portions of said second generally conductive layer to extend into respective openings formed in said first generally insulative layer to make contact with respective column lines of said first generally conductive layer.

97. A method of making a baseplate for a field emission display, comprising:

providing a non-conductive substrate having a generally rectangular, generally planar working surface;

forming a first layer of metal on at least a portion of the working surface of said substrate, said first metal layer being deposited to form a plurality of column lines that are isolated from each other and extend along a substantial portion of the working surface of said substrate, said first layer of metal having a first conductivity;

depositing a first oxide layer on at least a substantial portion of said column lines, said step of depositing said first oxide layer including forming respective openings in said first oxide layer over a plurality of said column lines to expose said column lines through said openings;

depositing a first layer of polysilicon material over at least a portion of said first oxide layer including said openings, said first polysilicon layer being deposited to form a plurality of column lines that are isolated from each other and extend into respective openings to contact respective column lines of said first layer of metal, said first layer of polysilicon material having a second conductivity that is less than said first conductivity;

forming a plurality of emitters on said first polysilicon layer, said emitters being arranged in rows and columns with the emitters in one column being isolated from the emitters in other columns and the emitters in each column being coupled to a respective column line of said first metal layer through a respective opening in said first oxide layer;

depositing a second oxide layer on a substantial portion of said first polysilicon layer;

forming a plurality of openings in said second oxide layer surrounding a respective plurality of said emitters;

depositing a layer of generally conductive material on at least a portion of said second oxide layer; and forming a plurality of openings in said layer of conductive material surrounding a respective plurality of said emitters, said layer of substantially conductive material forming a plurality of rows of extraction grids for said field emission display baseplate with the extraction grids in each row being coupled to each other and isolated from the extraction grids in other rows.

98. The method of claim 97 wherein said step of depositing a layer of substantially conductive material comprises depositing a second layer of polysilicon material on at least a portion of said second oxide layer, and wherein said method further comprises depositing a second layer of metal on at least a portion of said second polysilicon layer to form a plurality of row lines extending along a substantial portion of said second polysilicon layer, said row lines being isolated from each other and being coupled to respective portions of said second polysilicon layer forming the extraction grids in each row.

99. The method of claim 97 wherein said step of depositing a layer of substantially conductive material comprises depositing a second layer of metal on at least a portion of said second oxide layer to form said extraction grids in a plurality of row lines extending along a substantial portion of said second oxide layer, said row lines being isolated from each other so that the extraction grids in each row are coupled to each other and isolated from the extraction grids of other rows.

100. The method of claim 97 said step of depositing said first metal layer comprises depositing a layer of chromium on at least a portion of the working surface of said substrate.

101. The method of claim 97 wherein said step of depositing said first and second oxide layers comprises depositing respective layers of a silicon oxide.

* * * * *

UNITED STATES PATENT AND TRADEMARK OFFICE

CERTIFICATE OF CORRECTION

PATENT NO. : 6,144,351
DATED : November 7, 2000
INVENTOR(S) : Zimlich

It is certified that error appears in the above-identified patent and that said Letters Patent is hereby corrected as shown below:

Column 11,
Line 6 "material;" should read -- material, --

Column 12,
Line 59 "claim 39" should read -- claim 38 --

Column14,
Line 15 "screen;;" should read -- screen; --

Column 15,
Line 40 "drivers" should read -- drivers, --

Column 16,
Line 27 "an visible" should read -- a visible --
Line 46 "image," should read -- image; --

Column 18,
Line 3 "an visible" should read -- a visible --

Column 19,
Lines 40 and 42 "a layers" should read -- a layer --

Signed and Sealed this

Twenty-eighth Day of May, 2002

*Attest:*

*Attesting Officer*

JAMES E. ROGAN
*Director of the United States Patent and Trademark Office*